US009320347B1

(12) United States Patent
Skarzynski

(10) Patent No.: US 9,320,347 B1
(45) Date of Patent: Apr. 26, 2016

(54) SWEEPER DEVICE FOR RV SLIDE-OUTS

(71) Applicant: Piotr Skarzynski, Isanti, MN (US)

(72) Inventor: Piotr Skarzynski, Isanti, MN (US)

( * ) Notice: Subject to any disclaimer, the term of this patent is extended or adjusted under 35 U.S.C. 154(b) by 635 days.

(21) Appl. No.: 13/664,450

(22) Filed: Oct. 31, 2012

(51) Int. Cl.
*A46B 5/02* (2006.01)
*A46B 5/00* (2006.01)

(52) U.S. Cl.
CPC ..... *A46B 5/0045* (2013.01); *A46B 5/002* (2013.01); *A46B 5/0058* (2013.01); *A46B 5/0083* (2013.01)

(58) Field of Classification Search
CPC .... A46B 5/0045; A46B 5/0058; A46B 5/002; A46B 5/0083
See application file for complete search history.

(56) References Cited

U.S. PATENT DOCUMENTS

| | | | | | |
|---|---|---|---|---|---|
| 3,380,767 | A * | 4/1968 | Barth | 403/66 |
| 4,991,533 | A * | 2/1991 | Sterling | 114/222 |
| 5,943,727 | A * | 8/1999 | Freer | 15/144.1 |
| 6,032,321 | A * | 3/2000 | Shirey et al. | 15/244.2 |
| 6,155,620 | A * | 12/2000 | Armstrong | 294/57 |
| 6,189,222 | B1 * | 2/2001 | Doyle | 30/531 |
| 6,709,529 | B1 * | 3/2004 | Mekwinski | 134/6 |
| 8,418,321 | B1 * | 4/2013 | Heiman | 16/426 |
| 2004/0250367 | A1 * | 12/2004 | Fraser | 15/245 |
| 2005/0268416 | A1 * | 12/2005 | Sommers | 15/209.1 |

* cited by examiner

*Primary Examiner* — Randall Chin
(74) *Attorney, Agent, or Firm* — Dave Alan Lingbeck

(57) ABSTRACT

A sweeper device for RV slide-outs for safely and conveniently reaching hard-to-reach areas that needs to be swept. The sweeper device for RV slide-outs includes support members hingedly connected to one another for a user to effectively reach tops of RV slide-outs while standing upon a ground; hinge members interconnecting the support members; a handle assembly being attached to one of the support members; and a work member assembly being removably disposed to at least one of the support members for sweeping off the tops of RV slide-outs.

6 Claims, 4 Drawing Sheets

SWEEPER DEVICE FOR RV SLIDE-OUTS

BACKGROUND OF THE INVENTION

1. Field of the Invention

The present invention relates to sweepers and more particularly pertains to a new sweeper device for RV slide-outs for safely and conveniently reaching hard-to-reach areas that need to be swept.

2. Description of the Prior Art

The use of sweepers is known in the prior art. More specifically, sweepers heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a floor sweeping apparatus comprises a cleaning head with an elongate handle fixed at an inner end by a pivoting joint to the cleaning head, and at an outer end by a hinge to an elongate handle extension. A locking mechanism allows the handle extension to be locked in different angular positions relative to the handle and can be remotely controlled from the handle extension. Another prior art includes swabbing tool with a telescoping handle and a flexible tubular extension ending in a socket within which a variety of attachments can be inserted, to take swab samples of remote and distant surfaces, without someone having to actually climb up or go down to the surfaces, to determine whether a surface has been adequately cleaned. Yet, another prior art includes a cleaning implement includes a handle, a head, a first operative surface connected to the head, comprising bristles, a second operative surface connected to the head in opposing relation to the first operative head, the second operative surface being interchangeable among at least one cleaning element, and a swivel connected to the handle and the head. While these devices fulfill their respective, particular objectives and requirements, the aforementioned patents do not disclose a new sweeper device for RV slide-outs.

SUMMARY OF THE INVENTION

The general purpose of the present invention, which will be described subsequently in greater detail, is to provide a new sweeper device for RV slide-outs which has many of the advantages of the sweepers mentioned heretofore and many novel features that result in a new sweeper device for RV slide-outs which is not anticipated, rendered obvious, suggested, or even implied by any of the prior art sweepers, either alone or in any combination thereof. The present invention includes support members hingedly connected to one another for a user to effectively reach tops of RV slide-outs while standing upon a ground; hinge members interconnecting the support members; a handle assembly being attached to one of the support members; and a work member assembly being removably disposed to at least one of the support members for sweeping off the tops of RV slide-outs. None of the prior art includes the combination of the elements of the present invention.

There has thus been outlined, rather broadly, the more important features of the sweeper device for RV slide-outs in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new sweeper device for RV slide-outs which has many of the advantages of the sweepers mentioned heretofore and many novel features that result in a new sweeper device for RV slide-outs which is not anticipated, rendered obvious, suggested, or even implied by any of the prior art sweepers, either alone or in any combination thereof.

Still another object of the present invention is to provide a new sweeper device for RV slide-outs for safely and conveniently reaching hard-to-reach areas that need to be swept.

Still yet another object of the present invention is to provide a new sweeper device for RV slide-outs that is structured to sweep off the tops of the slide-outs before they are retracted within the RVs.

Even still another object of the present invention is to provide a new sweeper device for RV slide-outs that eliminates a user from having to dangerously climb up onto the slide-outs of the RVs to clean off the debris before retracting the slide-outs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
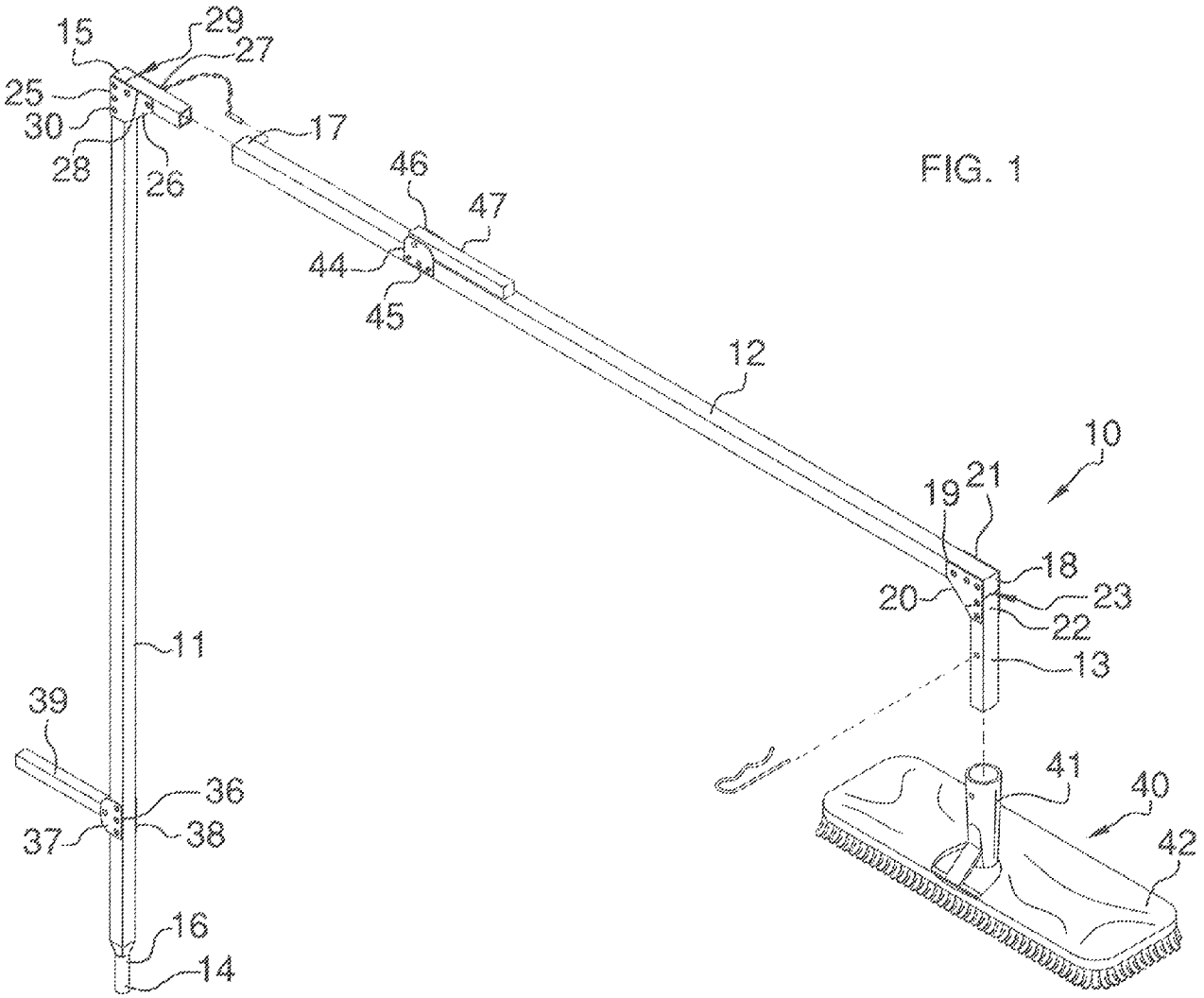
FIG. 1 is an exploded perspective view of a new sweeper device for RV slide-outs according to the present invention.
Figure 2:
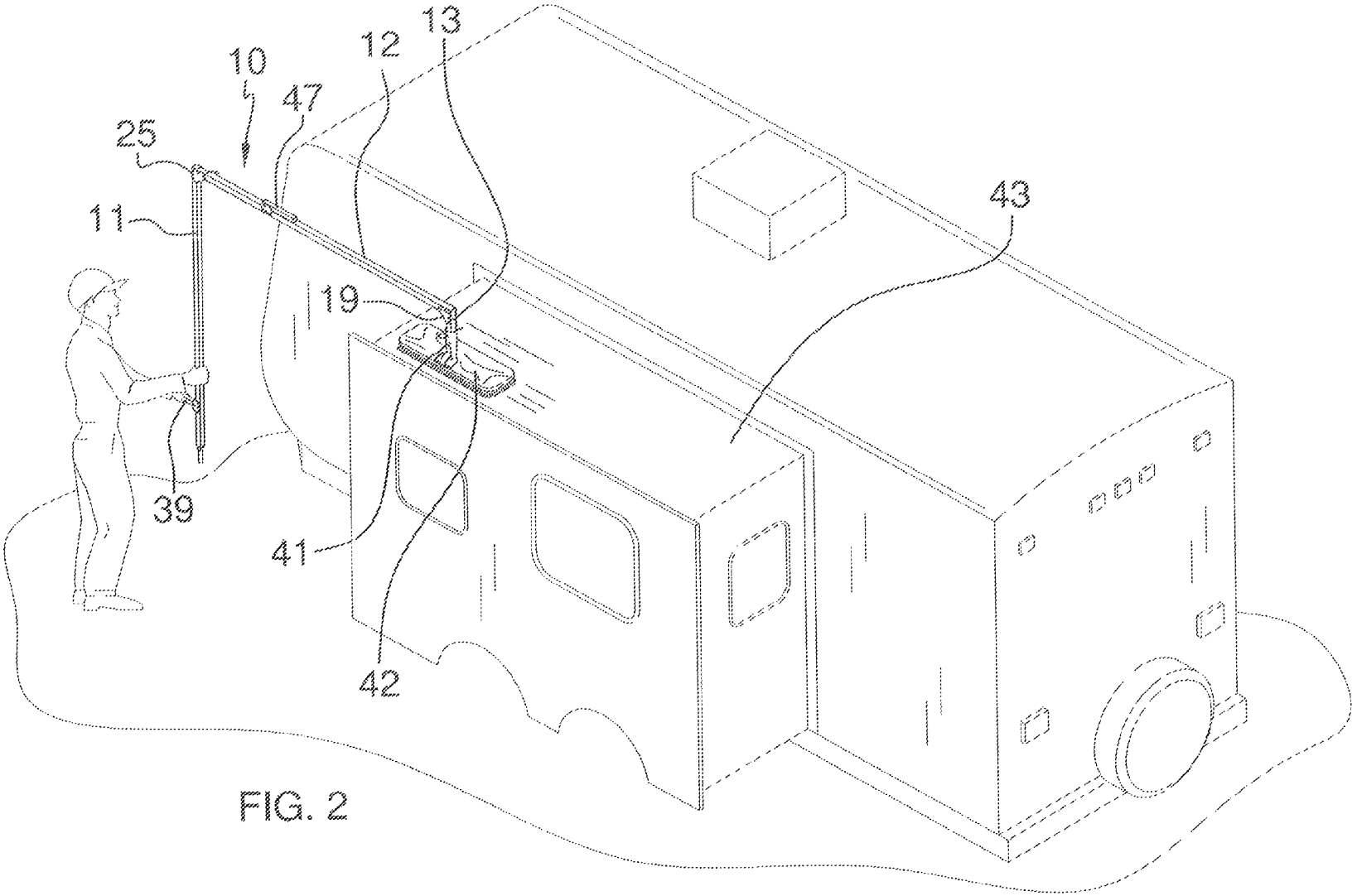
FIG. 2 is a perspective view of the present invention in use.
Figure 3:
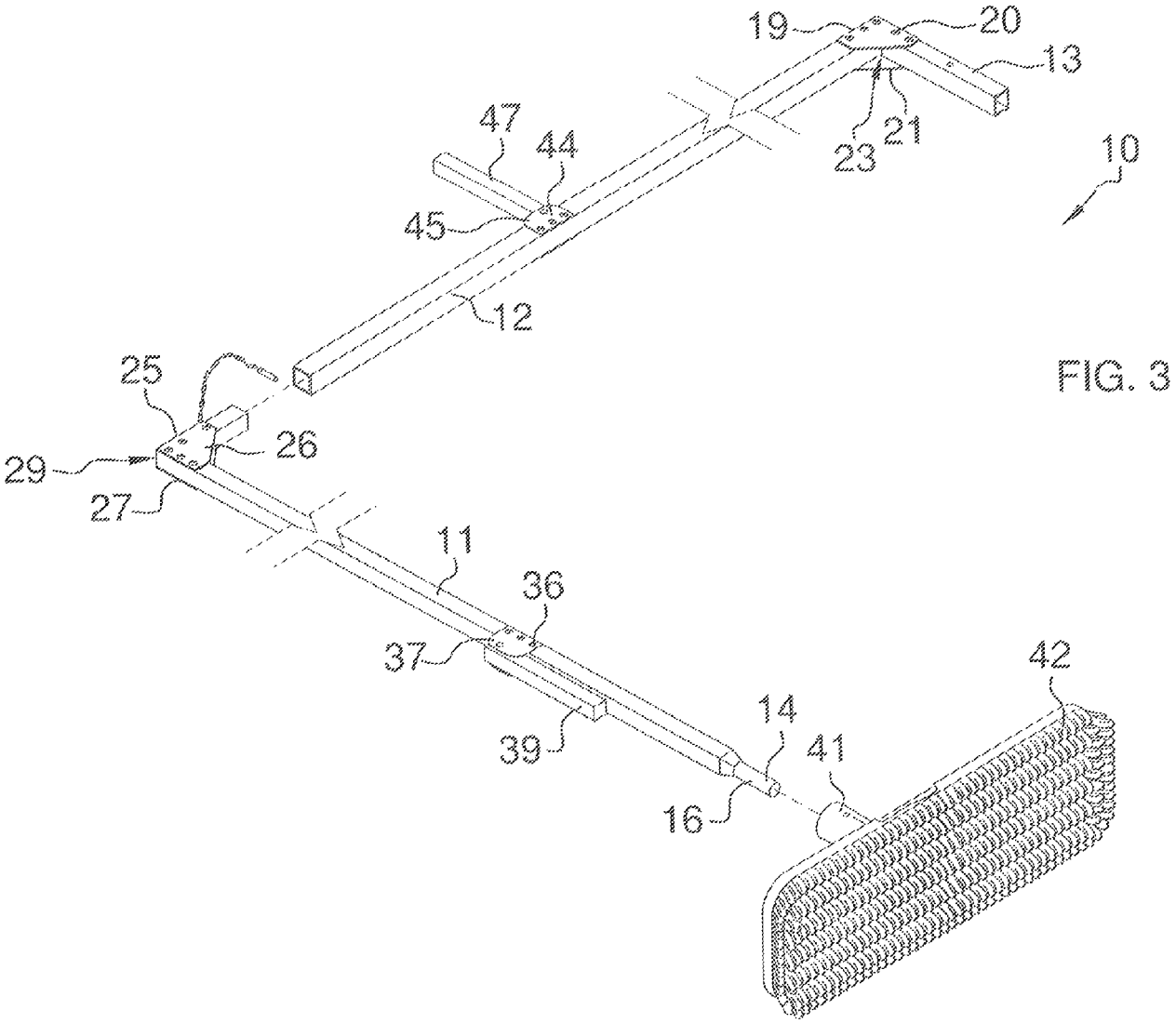
FIG. 3 is another exploded perspective view of the present invention.

With reference now to the drawings, and in particular to FIGS. 1 through 4 thereof, a new sweeper device for RV slide-outs embodying the principles and concepts of the present invention and generally designated by the reference numeral 10 will be described.

As best illustrated in FIGS. 1 through 4, the sweeper device for RV slide-outs 10 generally comprises support members 11-13 hingedly connected to one another and having lengths for a user to effectively reach tops of RV slide-outs 43 while standing upon a ground; and also comprises binge members 19,25,31 interconnecting the support members 11-13; a handle assembly 36 being attached to one of the support members 11-13; and a work member assembly 40 being removably disposed to at least one of the support members 11-13 for sweeping off the tops of RV slide-outs 43.

The support members 11-13 include a first elongate support member 11, a second elongate support member 12 being hingedly connected to the first elongate support member 11, and a third support member 13 being hingedly connected to the second elongate support member 12. The first elongate support member 11 has a work member-receiving end 14 and a distal end 15 and further has a recessed portion 16 extending from the work member-receiving end 14 and terminating a selected distance from the work member-receiving end 14. The second elongate support member 12 has a first end 17 being hingedly attached to the distal end 15 of the first elongate support member 11, and also has a second end 18. The third support member 13 is essentially a stub member being hingedly attached to the second end 18 of the second elongate support member 12.

Figure 4:
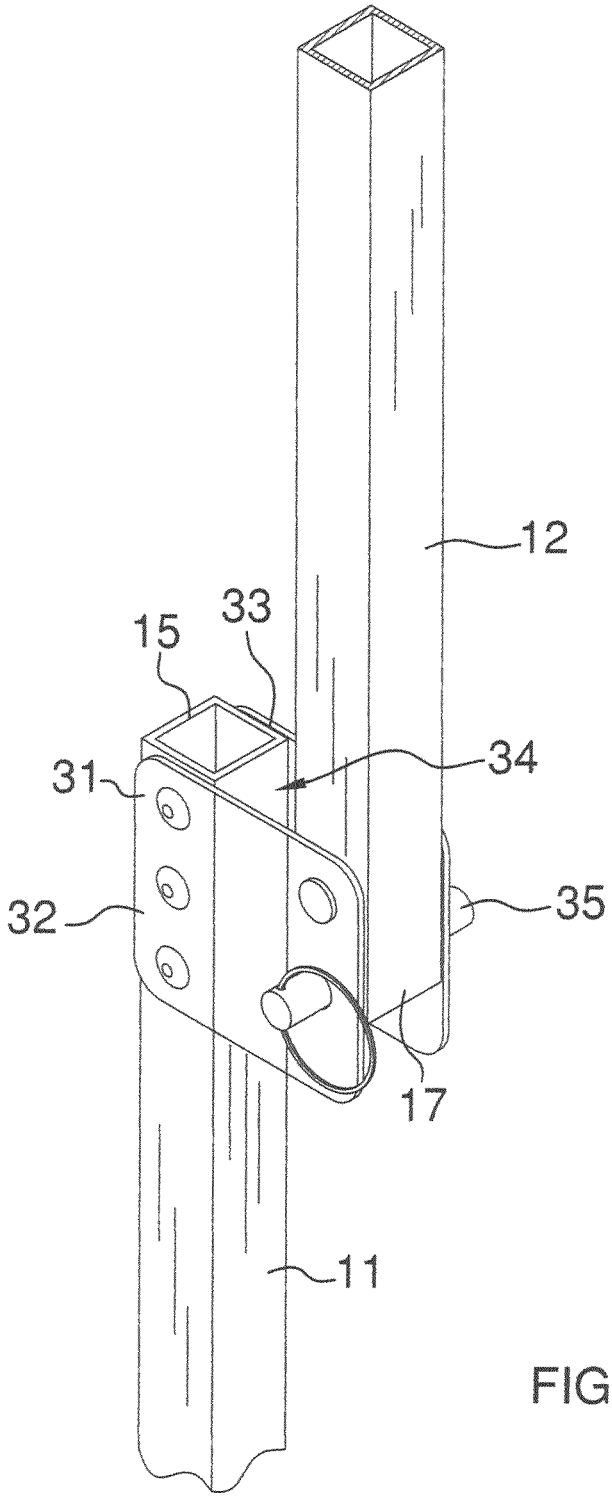
FIG. 4 is a partial perspective view of a second embodiment of the present invention.

The hinge members 19,25,31 include a first hinge member 19 being conventionally fastened to and interconnecting the second elongate support member 12 and the third support member 13 and having a pair of triangular-shaped side walls 20,21 being spaced apart and forming a slot 23 therebetween. The first hinge member 19 also has an end wall 22 conventionally interconnecting the side walls 20,21 and limiting extension of the third support member 13 relative to the second elongate support member 12. Upon being extended, the third support member 13 is disposed 90 degrees to the second elongate support member 12. The hinge members 19,25,31 include a second hinge member 25 being conventionally fastened to and interconnecting the first and second elongate support members 11,12 and having a pair of triangular-shaped side walls 26,27 being spaced apart and forming a slot 29 therebetween with each of the side walls 26,27 having holes 30 being disposed therethrough and being adapted to receive a fastener. The second hinge member 25 also has an end wall 28 interconnecting the side walls 26,27 and limiting extension of the second elongate support member 12 relative to the first elongate support member 11. Upon being extended, the second elongate support member 12 being disposed 90 degrees to the first elongate support member 11. As a second embodiment as shown in FIG. 4, the hinge members 19,25,31 also include a second hinge member 31 being conventionally fastened to and interconnecting the first and second elongate support members 11,12 and having a pair of side walls 32,33 being spaced apart and forming a slot 34 therebetween. The second hinge member 31 also has a locking spindle 35 conventionally interconnecting the side walls 32,33 of the second hinge member 31 and being conventionally attached to the second elongate support member 12 for rotation therewith. Upon extending the second elongate support member 12 relative to the first elongate support member 11, the second elongate support member 12 is disposed parallel to the first elongate support member 11.

The handle assembly 36,44 includes a pair of brackets 37,38 being conventionally attached with fastening members to the first elongate support member 11 and being spaced apart to form a slot therebetween and having holes being disposed through the brackets 37,38, and also includes a handle 39 being pivotally disposed in the slot and being conventionally attached to the brackets 37,38 with the handle 39 being capable of resting upon the first elongate support member 11. The handle assembly 36, 44 also includes a pair of brackets 45,46 being conventionally attached with fastening members to the second elongate support member 12 and being spaced apart to form a slot therebetween and having holes being disposed through the brackets 45,46, and also includes a handle 47 being pivotally disposed in the slot and being conventionally attached to the brackets 45,46 with the handle 47 being capable of resting upon the second elongate support member 12.

The work member assembly 40 includes a sleeve 41 being removably received about one of the support members 11-13, and also includes a work member 42 being swivelly and conventionally connected to the sleeve 41 for sweeping the tops of RV slide-outs 43. The work member 42 may be made of a cloth material and having a bottom side ideally suitable for cleaning surfaces. The sleeve 41 is removably received about the third support member 13. As another embodiment, the sleeve 41 is removably received about the work member-receiving end 14 and the recessed portion 16 of the first elongate support member 11.

In use, the user extends the sweeper device 10 to reach a top of a RV slide-out 43 with the work member 42 being engagable with the top of the RV slide-out 43 by extending the support members 11-13 relative to one another while the user is standing on a ground next to the RV. The user then moves the work member 42 upon the top of the RV slide-out 43 by grasping an end of one of the support members 11-13 while the user is standing on the ground. Upon finishing the sweeping of the top of the RV slide-out 43, the user remotes the work member 42 from the top of the RV slide-out 43 and folds the support members 11-13 upon one another and removes the work member 42 from the support members 11-13 for convenient storage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the sweeper device for RV slide-outs. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sweeper device for RV slide-outs comprising:

support members hingedly connected to one another and having lengths for a user to effectively reach tops of RV slide-outs while standing upon a ground, wherein said support members include a first elongate support member, a second elongate support member being hingedly connected to said first elongate support member, and a third support member which is a stub member being hingedly connected to said second elongate support member;

hinge members interconnecting said support members, wherein said hinge members also include a first hinge member interconnecting said second elongate support member and said third support member and having a pair of triangular-shaped side walls being spaced apart and forming a slot therebetween, said first hinge member also having an end wall interconnecting said side walls and limiting extension of said third support member relative to said second elongate support member, upon being extended said third support member being disposed 90 degrees to said second elongate support member;

a handle assembly being attached to at least one of said support members; and a work member assembly being removably disposed to at least one of said support members for sweeping off the tops of RV slide-outs.

2. The sweeper device for RV slide-outs as described in claim 1, wherein said hinge members include a second hinge member interconnecting said first and second elongate support members and having a pair of triangular-shaped side walls being spaced apart and forming a slot therebetween, each of said side walls having holes being disposed therethrough and being adapted to receive a fastener, said second hinge member also having an end wall interconnecting said side walls and limiting extension of said second elongate support member relative to said first elongate support member, upon being extended said second elongate support member being disposed 90 degrees to said first elongate support member and said first elongate support member being disposed parallel to said third support member.

3. The sweeper device for RV slide-outs as described in claim 1, wherein said hinge members also include a second hinge member interconnecting said first and second elongate support members and having a pair of side walls being spaced apart and forming a slot therebetween, said second hinge member also having a spindle interconnecting said side walls of said second hinge member and being attached to said second elongate support member for rotation therewith, and upon extending said second elongate support member relative to said first elongate support member said third support member being parallel to the first elongate support member.

4. A sweeper device for RV slide-outs comprising:

support members hingedly connected to one another and having lengths for a user to effectively reach tops of RV slide-outs while standing upon a ground, wherein said support members include a first elongate support member, a second elongate support member hingedly connected to said first elongate support member, and a third support member hingedly connected to said second elongate support member, wherein said first elongate support member has a work member-receiving end and a recessed portion at said work member-receiving end;

hinge members interconnecting said support members;

a handle assembly being attached to at least one of said support members; and a work member assembly being removably disposed to at least one of said support members for sweeping off the tops of RV slide-outs, wherein said work member assembly includes a sleeve being removably received about one of said support members, and also includes a work member being swivelly connected to said sleeve for sweeping the tops of RV slide-outs.

5. The sweeper device for RV slide-outs as described in claim 4, wherein said sleeve is removably received about said third support member.

6. The sweeper device for RV slide-outs as described in claim 4, wherein said sleeve is removably received about said work member-receiving end and said recessed portion of said first elongate support member.

* * * * *